United States Patent [19]

Weder

[11] Patent Number: 5,037,372

[45] Date of Patent: Aug. 6, 1991

[54] DRIVE SYSTEM FOR A DECANTING CENTRIFUGE

[75] Inventor: Heinrich Weder, Engelburg, Switzerland

[73] Assignee: Elatronic AG, Engelburg, Switzerland

[21] Appl. No.: 555,699

[22] Filed: Jul. 23, 1990

[30] Foreign Application Priority Data

Jul. 21, 1989 [CH] Switzerland ..... 2734/89

[51] Int. Cl.[5] ..... B04B 1/20

[52] U.S. Cl. ..... 494/53; 494/84

[58] Field of Search ..... 494/83, 84, 52, 53, 494/54, 82, 85; 210/781, 782, 360.1

[56] References Cited

U.S. PATENT DOCUMENTS 4,120,447 10/1978 Jager ..... 494/14

4,411,646 10/1983 Cyphelly ..... 494/84

4,421,502 12/1983 Jakobs ..... 494/53

FOREIGN PATENT DOCUMENTS 2237682 7/1974 France .

*Primary Examiner*—Robert W. Jenkins

*Attorney, Agent, or Firm*—Sughrue, Mion, Zinn, Macpeak and Seas

[57] ABSTRACT

The stator 3 of a low speed, high torque hydraulic motor I is coupled to the drum 2 of a decanting centrifuge, and the rotor 20 of the motor is coupled to a worm 1 within the drum to provide relative or differential rotation between the drum and worm. A light weight, high speed hydraulic motor II is coupled to an end disk extension 14 of the motor I rotor or stator in an overhanging, coaxial position, and its housing 16 is elastically braced against rotation. The speeds of both motors are independently controlled.

8 Claims, 1 Drawing Sheet

DRIVE SYSTEM FOR A DECANTING CENTRIFUGE

BACKGROUND OF THE INVENTION

This invention relates to a hydraulic motor drive system for a decanting centrifuge.

Decanting centrifuges, also called decanters in short, have been used for many years to separate large quantities of mixtures from solids and liquids in a continuous operation. Generally an electric motor which drives a drum by means of belts is used as the drive motor, and a worm which requires low relative speeds but high torques is driven by a torque converter via a co-rotational mechanical drive, with the low-torque connection of the drive being braced against an idle system. Such drive systems have the drawback of exhibiting fixed drive speeds, a feature that often significantly reduces both reliability, efficiency and also the results from a separating point of view.

The infinite variability of the relative speed of the worm is significant improvement. To this end, one category of such drives uses mechanically co-rotational drive units at whose low-torque connection a positive or negative slip is generated, whose degree in a given region can be adjusted arbitrarily.

Another category of such drives foregoes the mechanical drive unit as a torque converter by using a co-rotational, low-speed, high-torque hydraulic motor, whose rotor drives the worm and whose housing is connected to the drum, with the energization being transferred from a pump station, whose quantity can be adjusted, via a high pressure rotary transmission to the rotating system.

Such drive systems allow the relative speed of the worm to be completely independent of the speed of the main drive and, if the rotary transmission has a radial introduction, a coaxial arrangement of the two drive motors is allowed, as taught in U.S. Pat. No. 4,120,447 or French patent No. 2,237,682. Such an arrangement allows belt drives to be dispensed with, especially if the main drive motor has a constant speed. In both drive systems the main drive motor is attached permanently to the machine bed. In addition to the direct and indirect cost savings, this results in the important elimination of transverse forces on the bearings due to the belt tension on the machine main bearing, a state that has a positive effect on the service life and reliability of these highly stressed elements.

Coaxial arrangements, as explained above, require exact centering and alignment of the main drive motor, with an absolutely rigid construction, which incurs additional cost. Such a construction is made even more difficult when the machine rotor has a certain degree of freedom with respect to the idle system, be it for vibrational reasons a radial-elastic bearing suspension or a degree of freedom on an axis arranged at an angle for vertical machines suspended to oscillate. In this case the only way to produce a connection to the main drive motor is with expensive and space-consuming cardan joint systems.

SUMMARY OF THE INVENTION

An object of the invention is to provide a drive system of the above category, which avoids the stated drawbacks and which, nevertheless, can be manufactured cost-effectively and is operationally reliable.

In the drive system of the invention the main high performance hydraulic drive motor is suspended from the differential drive machine rotor. Since the main motor is very light-weight, it can vibrate without any significant repercussions. Even severe vibrations near the critical speed are absorbed by the high-speed hydraulic motor. Thus, hardly detectable transverse forces on the machine bearing are generated by the overhung disposition or mounting of the high-speed hydraulic motor. Here, the extremely good weight to horsepower ratio of the hydrostatic motor, which allows such an arrangement, is important.

According to another feature of the invention, the nonrotating housing of the high-speed hydraulic motor is braced symmetrically and flexibly against a stationary mass. The feed lines for both machines are preferably flexible.

DETAILED DESCRIPTION OF THE PREFERRED EMBODIMENTS

Figure 1:
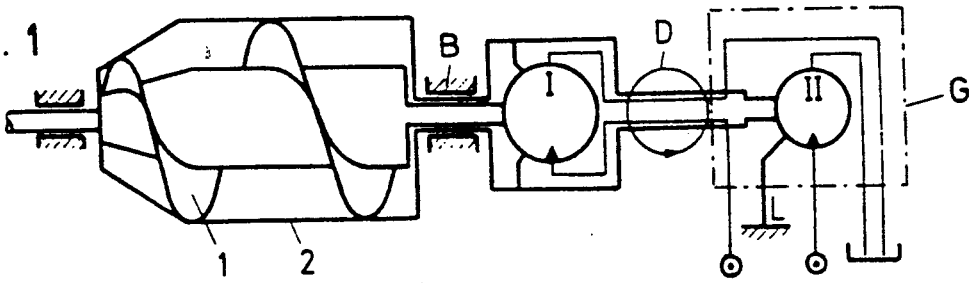
FIGS. 1 to 4 are schematic views of four embodiments of the drive according to the invention for a decanting centrifuge.

The drive system of the invention utilizes a high-torque, low-speed hydraulic motor I for generating a differential speed between a worm 1 and a drum 2 of the decanting centrifuge. Stator 3 of hydraulic motor I is connected rigidly to drum 2, whereas rotor 20 rotates with worm 1. Hydraulic motor I is fed by a rotary transmission D with pressurized fluid, which is fed in and out over flexible lines 11.

The drive system further includes a high-speed hydraulic motor II, which drives the above equipment including the drum 2, the worm 1 and the hydraulic motor I. Hydraulic motor II is, for example, a tilted drum or tilted disk machine and is disposed in an overhung position on the rotating equipment rotor shaft 4. Pressurized fluid is fed in and out by flexible lines 7, which are attached to the non-rotating housing 16 of hydraulic motor II. With arms L the torque of housing 16 is braced against a stationary mass 13. The torque of housing 16 is preferably braced symmetrically and elastically against mass 13 with several arms L. The elastic bracing is realized, for example, with a rubber member(s) 12. Thus, arms L have no carrying or support function, but instead merely prevent housing 16 from rotating. The comparably lightweight hydraulic motor II can thus vibrate along with rotor shaft 4; it can so-to-say "dance along" freely on said shaft 4.

Figure 4:
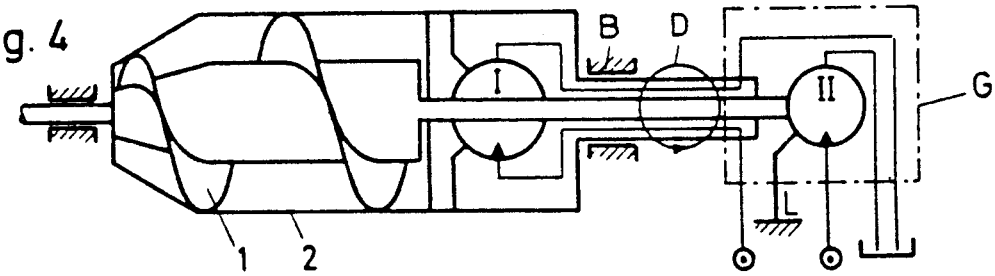
Figure 5:
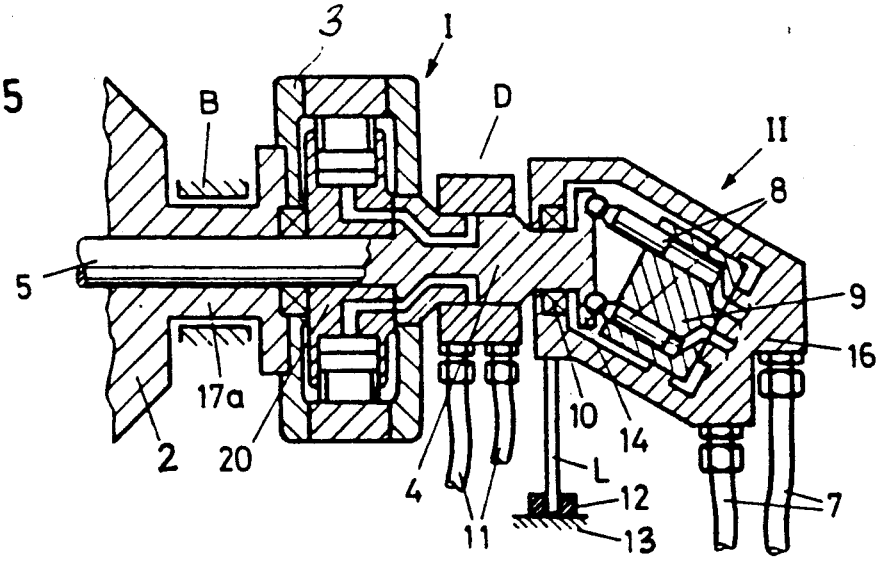
FIG. 5 is a schematic axial view of the design of the drive according to FIGS. 2 and 4.

As shown in FIG. 5, rotor shaft 4 rotates in a bearing 10 of housing 16 and has an end disk 14 disposed in the housing. A rotor 9 of motor II has several pistons 8. The force of the pistons 8 imparts to rotor shaft 4 a torque with which the drum system or the worm shaft 5 is driven directly. In the embodiments of FIGS. 1 and 3, hydraulic motor II drives the drum system, whereas, according to the embodiments of FIGS. 2 and 4, hydraulic motor II drives the worm shaft 5. In the former case, the stator 3 of motor I would be coupled to an end disk, comparable to disk 14, journaled within the housing 16 of motor II.

Figure 2:
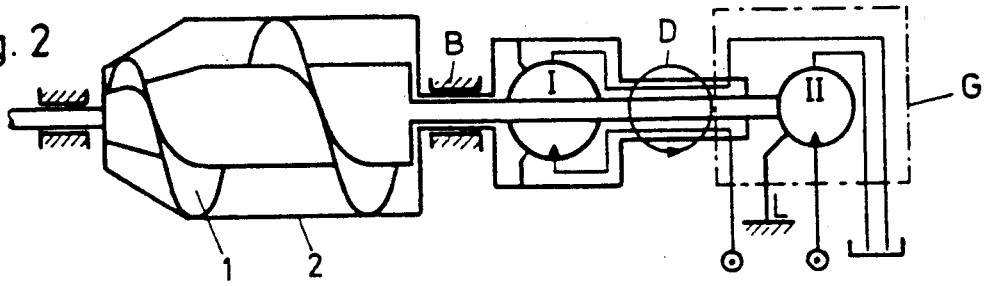
Figure 3:
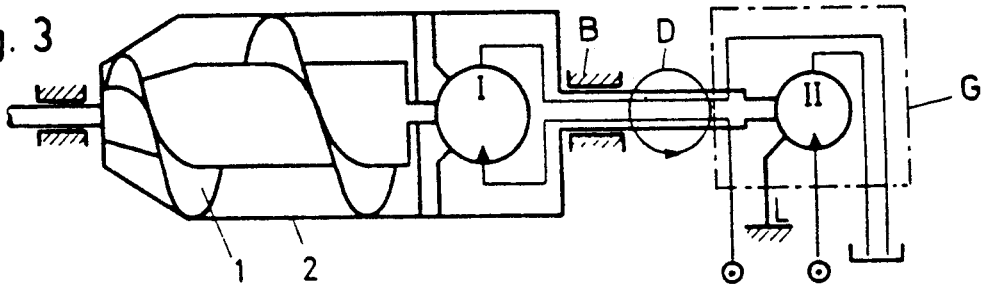

According to FIGS. 1 and 2, hydraulic motor I can be arranged outside a main bearing B and, according to FIGS. 3 and 4, within the main bearing.

According to an embodiment not shown, the connections of rotary transmission D, which feed the hydraulic motor, are housed in housing 16 of hydraulic motor II. Thus, significant compactness is achieved here, a feature that can be increased by also housing the rotary transmission D in housing 16.

In summary, the above embodiments yield a drive which can be realized with relatively few, simple and robust components, so that a drive can be provided according to the invention that exhibits in particular the following advantages:

significant economy of weight with a negligible tendency toward oscillation.

since the drive generates in essence no transverse forces on the bearings, the rotor runs quieter; and for better vibrational isolation, flexible main mountings can be installed, the main speed of motor II and the differential speed of motor I can be adjusted infinitely, drive displacement systems, machine frame distributions and consoles are dispensed with, belt drives and associated belt protection devices are also dispensed with, and a very compact design can be obtained with little loading.

I claim:

1. Drive system for a decanting centrifuge including a worm (1) rotatably disposed within a drum (2), said drive system comprising: first and second coaxial hydrostatic motors (I, II), the first motor being a high-torque, low-speed hydraulic motor (I) having a rotor (20), a rotor shaft (4) and a stator (3) for generating a differential speed between the worm and the drum of the centrifuge, with the stator of said first motor connected to the drum and the rotor of said first motor connected to the worm (1) and fed with pressurized fluid by a rotary transmission (D), the second motor being a lighter weight, high-speed hydraulic motor (II) for driving rotating equipment including the first motor, the drum and the worm, wherein the second motor is disposed in an overhung position on an end of the rotor shaft of the first motor, and wherein a housing (16) of the second motor is suspended on said rotor shaft (4) and is braced against rotation on a stationary mass (13) by a plurality of arms (L).

2. Drive system as claimed in claim 1, wherein both motors lie together outside a main machine bearing (B) of the centrifuge.

3. Drive system as claimed in claim 2, wherein the main bearing (B) of the centrifuge is disposed on an extension (17*a*) of the stator of the first motor.

4. Drive system as claimed in claim 1 or 2, wherein the second motor drives a shaft (5) of the worm.

5. Drive system as claimed in claims 1 or 2, wherein the second motor drives the stator of the first motor.

6. Drive system as claimed in claims 1 or 2, wherein connections to the rotary transmission (D) for energizing the first motor are disposed in the housing of the second motor.

7. Drive system as claimed in claim 1, wherein the housing (16) of the second motor is symmetrically braced against the stationary mass.

8. Drive system as claimed in claim 7, wherein the housing of the second motor is elastically braced (12) against the stationary mass (13).

* * * * *